US007293870B2

(12) United States Patent
Yu

(10) Patent No.: US 7,293,870 B2
(45) Date of Patent: Nov. 13, 2007

(54) SUPPORTING STRUCTURE AND BUSINESS MACHINE UTILIZING THE SAME

(75) Inventor: Chin-Shu Yu, Taipei (TW)

(73) Assignee: BENQ Corporation, Taoyuan (TW)

( * ) Notice: Subject to any disclaimer, the term of this patent is extended or adjusted under 35 U.S.C. 154(b) by 401 days.

(21) Appl. No.: 10/882,869

(22) Filed: Jul. 1, 2004

(65) Prior Publication Data

US 2005/0001893 A1 Jan. 6, 2005

(30) Foreign Application Priority Data

Jul. 4, 2003 (TW) ..... 92212326 U

(51) Int. Cl.
*B41J 29/13* (2006.01)

(52) U.S. Cl. ..... 347/108; 347/138; 347/152; 347/170; 347/222; 346/145; 400/691; 400/692; 400/693; 400/693.1; 400/694

(58) Field of Classification Search ..... 347/108, 347/138, 152, 170, 222; 400/691–694, 693.1; 346/145

See application file for complete search history.

(56) References Cited

U.S. PATENT DOCUMENTS 5,931,537 A * 8/1999 Gollin et al. ..... 297/411.36

* cited by examiner

*Primary Examiner*—Manish S. Shah
*Assistant Examiner*—L E Martin
(74) *Attorney, Agent, or Firm*—Quintero Law Office

(57) ABSTRACT

A supporting structure and a Business machine utilizing the same. The business machine includes a main body, cover and supporting structure therebetween. The sleeve connected to the main body has a guiding groove with a lug portion. The connecting rod is connected to the cover and movably disposed in the sleeve. The connecting rod has a cantilever with a hook portion confined in the guiding groove. The guiding groove has a predetermined profile, such that the cover is lifted before closing, protecting the main body from accidental collision.

21 Claims, 6 Drawing Sheets

SUPPORTING STRUCTURE AND BUSINESS MACHINE UTILIZING THE SAME

BACKGROUND OF THE INVENTION

1. Field of the Invention

The present invention relates to a supporting structure, and in particular to a supporting structure to assist in opening and closing the cover of a business machine.

2. Description of the Related Art

When exchanging ink cartridges in a conventional business machine, a cover thereof must be opened, exposing the ink cartridges therein. A basic requirement for users when replacing ink cartridges is that the cover can be lifted easily and held in a predetermined open position.

A conventional business machine 10 is shown in FIGS. 1*a* and 1*b*. The business machine 10 comprises a cover 12 pivoting on the main body 11 and a supporting structure 13 therebetween. The supporting structure 13 has a linkage 131 with a first slot 133. The linkage 131 pivots on the cover 12 at one end and connects to a second slot 134 of a seat 132 in the main body 11 through a joint 135 at the other. The joint 135, thus, can slide in the first and second slots 133, 134 when the cover 12 is being opened or closed. In FIG. 1*a*, the cover 12 is closed and the joint 135 is on the left side of the second slot 134. When the cover 12 is lifted, the linkage 131 is moved and pushes the joint 135 rightward to the right side of the second slot 134 and a bottom position of the first slot 133 as shown in FIG. 1*b*. Because the first slot 133 has a neck portion at its bottom end, force is required to allow the joint 135 to re-enter the middle portion of the first slot 133 when the cover 12 is closed. Thus, the position of the opened cover 12 can be maintained, but the cover 12 can easily close and collide with the main body 11, under unexpected force.

SUMMARY OF THE INVENTION

The present invention provides a supporting structure comprising a sleeve and a connecting rod. The sleeve has a guiding groove with a lug portion. The connecting rod, movably disposed in the sleeve, has a cantilever with a hook portion confined in the guiding groove. The guiding groove has a predetermined profile, such that the cantilever deforms in a first direction when the hook portion passes the lug portion.

The present invention further provides a business machine comprising a main body, cover and supporting structure therebetween. The sleeve connected to the main body has a guiding groove with a lug portion. The connecting rod is connected to the cover and is movably disposed in the sleeve. The connecting rod has a cantilever with a hook portion confined in the guiding groove. The guiding groove has a predetermined profile, such that the cantilever deforms in a first direction when the hook portion passes the lug portion.

Accordingly, when the cover of the business machine is opened, the hook portion of the connecting rod moves along the guiding groove, and the lug portion of the sleeve engages the hook portion, providing sufficient support for the cover, such that the position thereof is temporarily locked. When the cover is closed, the cover should be lifted first, allowing the hook portion to temporarily leave the guiding groove without interfering with the lug portion, and is then pushed downward, directing the hook portion to the bottom of the sleeve. The cover is lifted before being pressed down, protecting the main body from accidental collisions with the cover.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention can be more fully understood by reading the subsequent detailed description and examples with references made to the accompanying drawings which are given by way of illustration only, and thus are not limitation of the present invention, and wherein.

DETAILED DESCRIPTION OF THE INVENTION

Figure 1A:
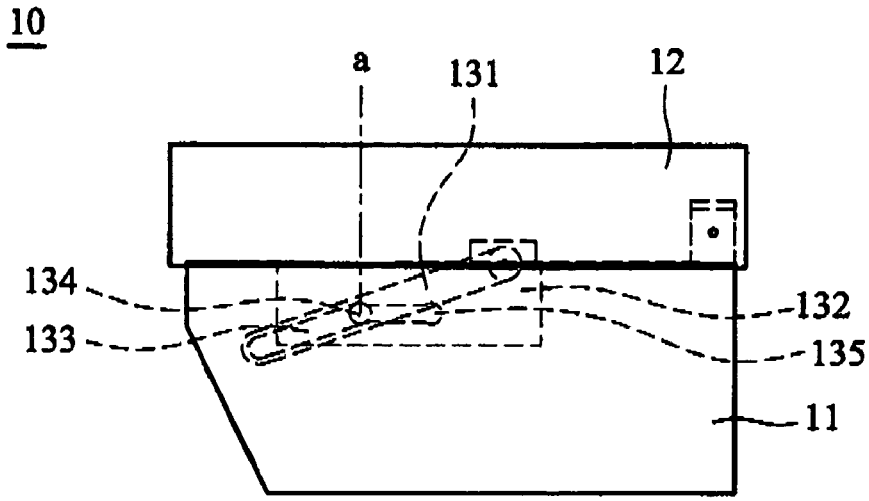
FIG. 1a ( RELATED ART )
FIGS. 1*a*~1*b* are schematic views of a supporting structure of a conventional business machine.
Figure 1B:
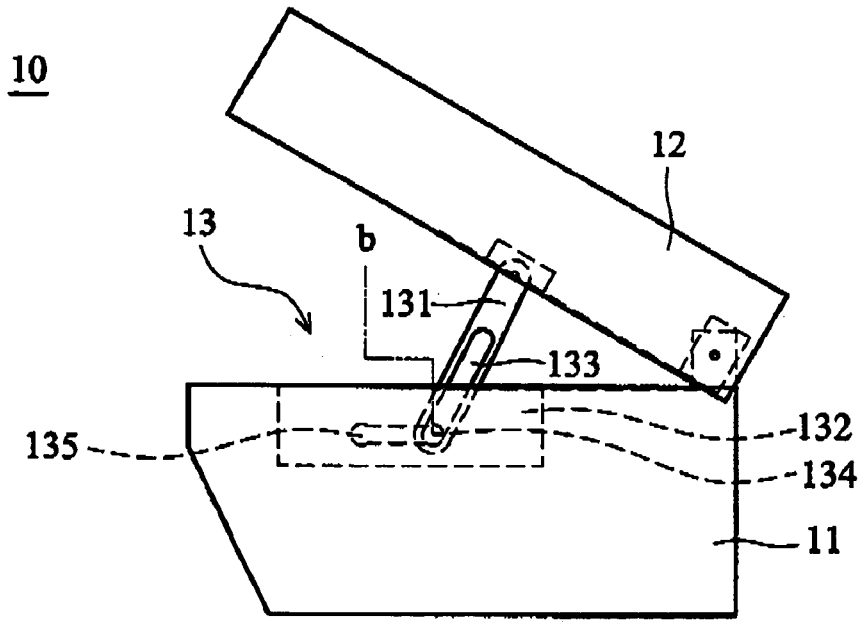
FIG. 1b ( RELATED ART )
Figure 2A:
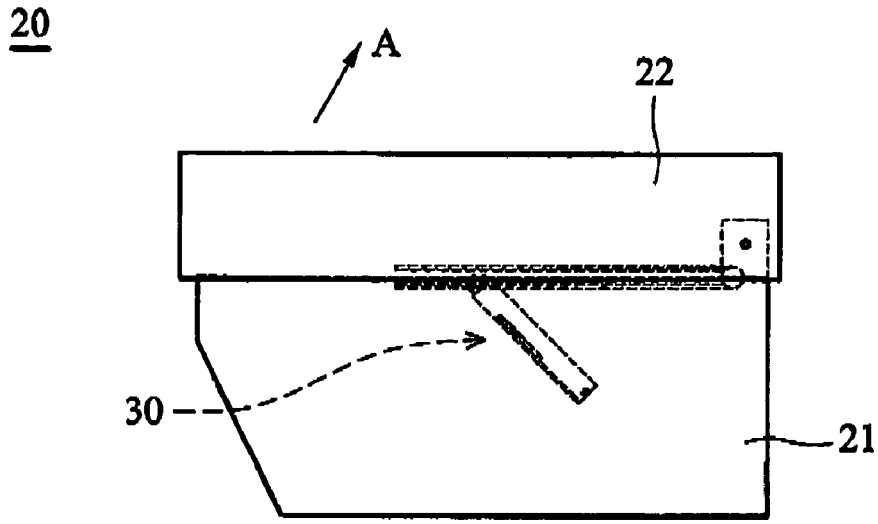
FIGS. 2*a*~2*b* are schematic views of a business machine of the invention.
Figure 2B:
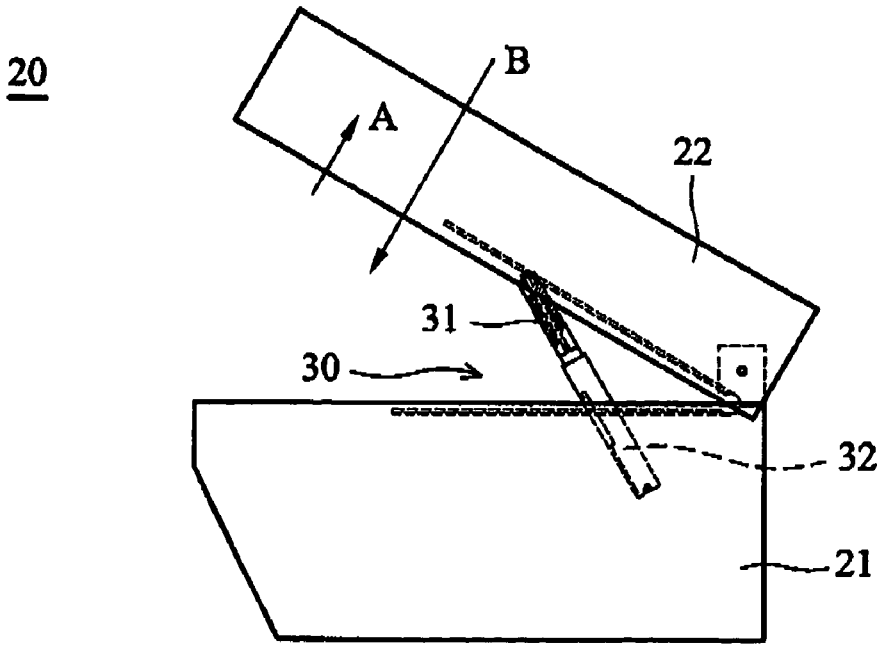

A business machine of the invention is shown in FIGS. 2*a*~2*b*. The business machine 20 comprises a cover 22 pivoting on a main body 22 and a supporting structure 30 therebetween. FIG. 2*a* shows the business machine 20 having the cover 22 closed with opening direction shown by arrow A. FIG. 2*b* shows the business machine 20 with the cover 22 open. As shown in FIG. 2*b*, the supporting structure 30 of the business machine 20 comprises a sleeve 32 and a connecting rod 31 disposed therein. The connecting rod 31 of the supporting structure 30 pivots on the cover 31 at one and, and the sleeve 32 pivots on the main body 21 at the other. When the cover 22 is opened, the connected rod 31 extends and prevents the cover 22 from falling. When the cover 22 is closed, the cover 2 is lifted slightly in the direction of arrow A and then pressed in the direction of arrow B to the original position in FIG. 2*a*.

The supporting structure 30 has a specific profile to support the opened cover 22 of the business machine 20. The restriction on lifting before the cover is closed, thus, protects the main body 21 from accidental collision with the cover 22 when replacing ink cartridges.

Figure 3A:
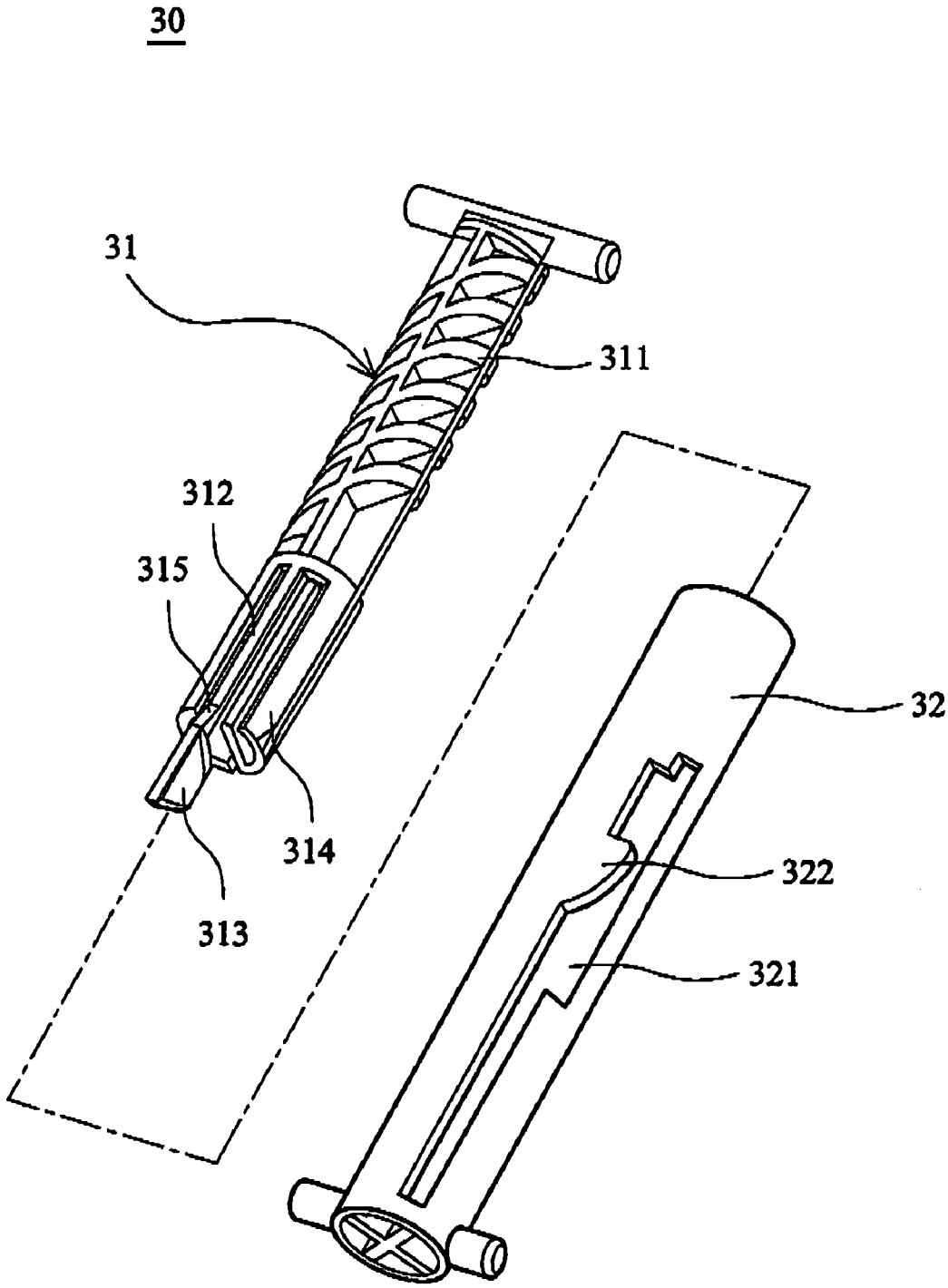
FIGS. 3*a*~3*b* are exploded views of a supported structure in a preferred embodiment.
Figure 3B:
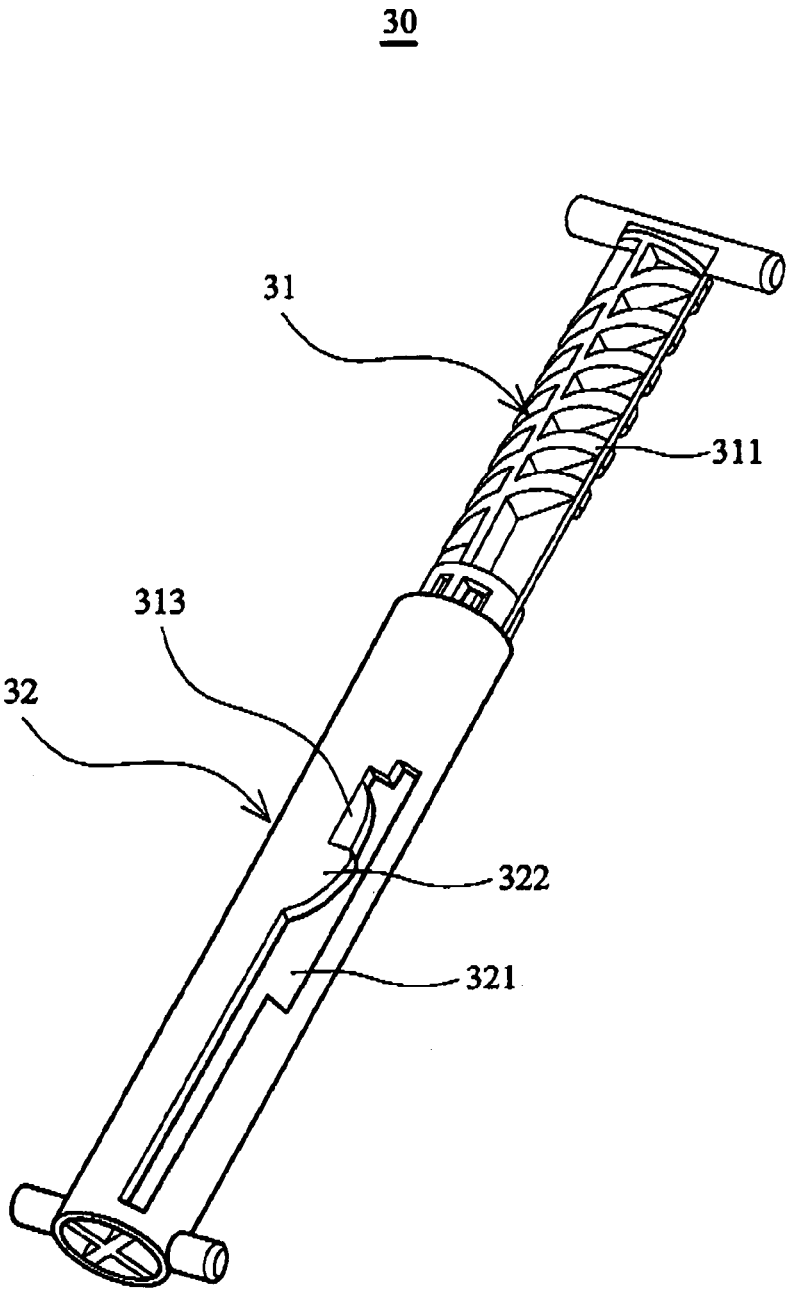

FIGS. 3*a*~3*b* show a preferred supporting structure 30 with a sleeve 32 and a connecting rod 31. The sleeve 32 has a guiding groove 321 and a lug portion 322. The guiding groove 321 is separated into a first slot 3211 and a second slot 3212 by the lug portion 322, and the first and second slot 3211, 3212 are not arranged in the same line. The connecting rod 31 has a plurality of ribs 311, a cantilever 312 and a guiding plate 314. The ribs 311 strengthen the structure thereof. The guiding plate 314 faces the cantilever 312, restricting deformation of the cantilever 312. The cantilever 312 has a hook portion 313 confined in the guiding groove 321 when the connecting rod 31 is disposed in the sleeve 32 as shown in FIG. 3*b*.

FIGS. 4*a*~4*f* show the supporting structure 30 functioning in this preferred embodiment. In order to simplify the drawings, the main body and the cover of the business machine are not shown. Furthermore, the first slot 321 and the second slot 322 are parallel, but not in the same line. The left surface of the first and second slot 3211, 3212 have a interval P therebetween.

Figure 4C:
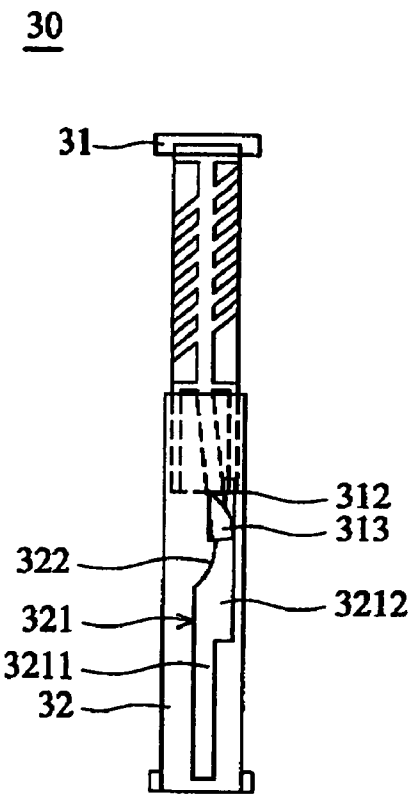
FIGS. 4*a*~4*f* show the supporting structure functioning in the preferred embodiment.
Figure 4B:
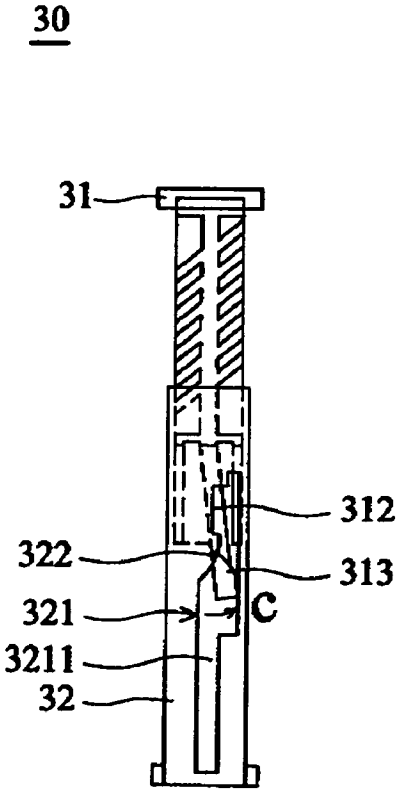
Figure 4A:
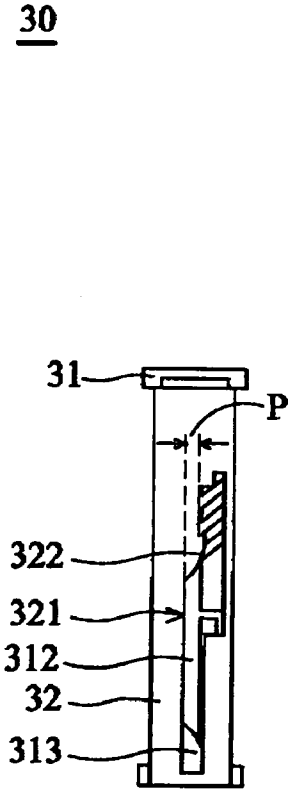

In FIG. 4*a*, the connecting rod 31 is disposed in the sleeve 32. The hook portion 313 is in a first position in the first slot 3211 of the guiding groove 321, contacting the bottom of the sleeve 32 when the cover is closed. At this time, the cantilever 312 is not deformed.

As the cover is opened in FIG. 2*a*, the hook portion 313 slides along the first slot 3211, contacting the lug portion 322. The cantilever 312 is deformed in a first direction C, forced rightward in FIG. 4*b*, for example, when the hook portion 313 passes the lug portion 322 of the guiding groove 321. Then, the cover 22 is further lifted, and the hook portion 313 passes the lug portion 322, arriving a second position in second slot 3212 of the guiding groove 321 as shown in FIG. 4*c*. At the same time, the cantilever 312 is deformed slightly rightward, and the hook portion 313 is pressed on the left surface of the second slot 3212, supported by the lug portion 322. The cover 22 of the business machine 20, is thus fixed in the open position, preventing the cover 22 from falling.

Figure 4F:
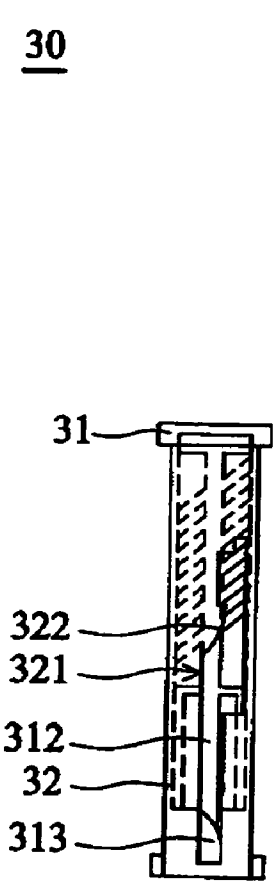
Figure 4E:
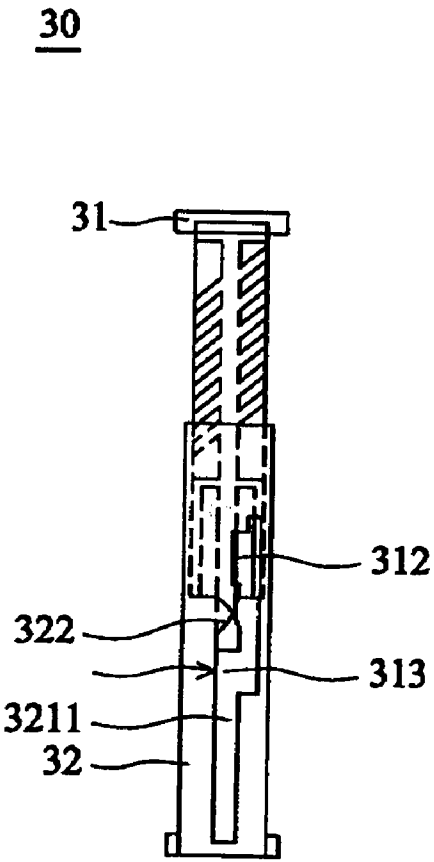
Figure 4D:
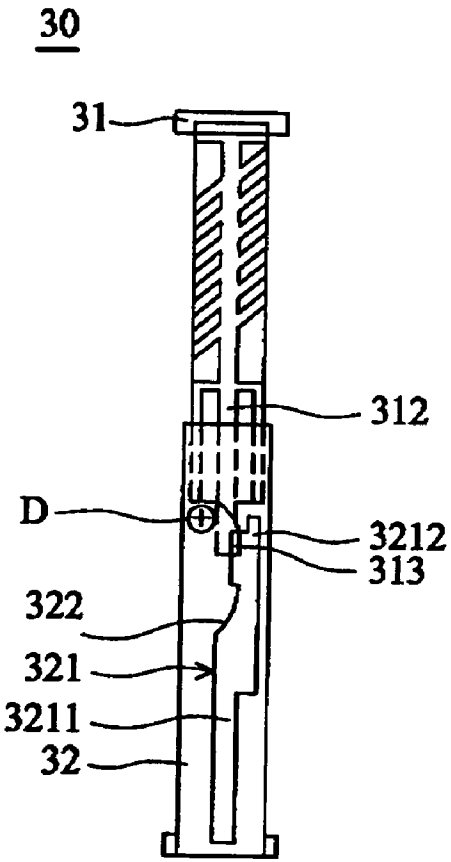

When closing, the cover 22 is first slightly lifted, and the connecting rod 31 moved to a third position in the sleeve 32 as shown in FIG. 4*d*. At the same time, the cantilever 312 is deformed in a second direction D, or the radial direction of the sleeve 32, with the hook portion 313 pressed into the sleeve 32, but is not deformed in the first direction. Furthermore, the hook portion 313 of this embodiment has a lead angle 315 as shown in FIG. 3*a*. The lead angle 315 helps the hook portion 313 to be pressed into the sleeve 32, returning its original position in the first direction. In FIGS. 4*d*~4*e*, the hook portion 313 passes the lug portion 322 of the guiding groove 321 without interference. After passing the lug portion 322, the hook portion 313 returns to the first slot 3211 and the cantilever 312 is restored in the second direction. As the cover 22 is further closed, the connecting rod 31 moves downward and returns to the first position in the sleeve 32 as shown in FIG. 4*f*. Furthermore, the sleeve 32 and the connecting rod 31 can be alternatively connected to the cover 22 and the main body 21 of the business machine 20, supporting the cover 22 thereof.

Accordingly, when the cover 22 of the business machine 20 is opened, the hook portion 313 of the connecting rod 31 moves along the guiding groove 321 and the lug portion 322 of the sleeve 32 engages the hook portion 313, providing sufficient support for the cover 22 and fixing the position thereof. When the cover 22 is closed, the cover 22 is lifted first, allowing the hook portion 313 to temporarily leave the guiding groove 321, and is then pushed downward, directing the hook portion 313 back to the guiding groove 321 without interfering with the lug portion 322. Because the cover 22 is lifted before closing to release the hook portion 313, the cover 22 will not close and collide with the main body 21 when under unexpected force.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A supporting structure, comprising:

a sleeve having a guiding groove with a lug portion; and a connecting rod movably disposed in the sleeve and having a cantilever with a hook portion confined in the guiding groove, wherein the guiding groove has a predetermined profile, and the cantilever is deformed in a first direction when the hook portion passes the lug portion;

wherein the cantilever is not deformed with the hook portion confined in the guiding groove when the connecting rod is in a first position, the cantilever is deformed in the first direction with the hook portion pressed on the lug portion when the connecting rod is in a second position, and the cantilever is deformed in a second direction with the hook portion pressed into the sleeve when the connecting rod is in a third position;

and wherein the guiding groove is separated into a first slot and a second slot by the lug portion, the hook portion is confined in the first slot when arriving at the first position but in the second slot when arriving at the second position, and the first slot and the second slot are not arranged in the same line.

2. The supporting structure, as claimed in claim 1, wherein the second direction is the radial direction of the sleeve.

3. The supporting structure, as claimed in claim 1, wherein the cantilever is not deformed in the first direction when the connecting rod is in the third position.

4. The supporting structure, as claimed in claim 1, wherein the hook portion is at the end of the cantilever.

5. The supporting structure, as claimed in claim 1, wherein the hook portion has a lead angle.

6. The supporting structure, as claimed in claim 1, wherein the connecting rod has a guiding plate facing the cantilever.

7. The supporting structure, as claimed in claim 1, wherein the connecting rod has a plurality of ribs.

8. A business machine, comprising:

a main body;

a cover rotatably connected to the main body;

a sleeve connected to the main body and having a guiding groove with a lug portion; and a connecting rod connected to the cover and movably disposed in the sleeve wherein the connecting rod has a cantilever with a hook portion confined in the guiding groove, the guiding groove has a predetermined profile, and the cantilever is deformed in a first direction when the hook portion passes by the lug portion;

wherein the cantilever is not deformed with the hook portion confined in the guiding groove when the connecting rod is in a first position, the cantilever is deformed in the first direction with the hook portion pressed on the lug portion when the connecting rod is in a second position, and the cantilever is deformed in a second direction with the hook portion pressed into the sleeve when the connecting rod is in a third position;

and wherein the guiding groove is separated into a first slot and a second slot by the lug portion, the hook portion is confined in the first slot when arriving at the first position but in the second slot when arriving at the second position, and the first slot and the second slot are not arranged in the same line.

9. The business machine, as claimed in claim 8, wherein the second direction is the radial direction of the sleeve.

10. The business machine, as claimed in claim 8, wherein the cantilever is not deformed in the first direction when the connecting rod is in the third position.

11. The business machine, as claimed in claim 8, wherein the hook portion is at the end of the cantilever.

12. The business machine, as claimed in claim 8, wherein the hook portion has a lead angle.

13. The business machine, as claimed in claim 8, wherein the connecting rod has a guiding plate facing the cantilever.

14. The business machine, as claimed in claim 8, wherein the connecting rod has a plurality of ribs.

15. A business machine, comprising:

a main body;

a cover rotatably connected to the main body;

a sleeve connected to the cover and having a guiding groove with a lug portion; and a connecting rod connected to the main body and movably disposed in the sleeve wherein the connecting rod has a cantilever with a hook portion confined in the guiding groove, the guiding groove has a predetermined profile, and the cantilever is deformed in a first direction when the hook portion passes the lug portion;

wherein the cantilever is not deformed with the hook portion confined in the guiding groove when the connecting rod is in a first position, the cantilever is deformed in the first direction with the hook portion pressed on the lug portion when the connecting rod is in a second position, and the cantilever is deformed in a second direction with the hook portion pressed into the sleeve when the connecting rod is in a third position;

and wherein the guiding groove is separated into a first slot and a second slot by the lug portion, the hook portion is confined in the first slot when arriving at the first position but in the second slot when arriving at the second position, and the first slot and the second slot are not arranged in the same line.

16. The business machine, as claimed in claim 15, wherein the second direction is the radial direction of the sleeve.

17. The business machine, as claimed in claim 15, wherein the cantilever is not deformed in the first direction when the connecting rod is in the third position.

18. The business machine, as claimed in claim 15, wherein the hook portion is at the end of the cantilever.

19. The business machine, as claimed in claim 15, wherein the hook portion has a lead angle.

20. The business machine, as claimed in claim 15, wherein the connecting rod has a guiding plate facing to the cantilever.

21. The business machine, as claimed in claim 15, wherein the connecting rod has a plurality of ribs.

* * * * *